US008240257B2

(12) United States Patent
Frost

(10) Patent No.: US 8,240,257 B2
(45) Date of Patent: Aug. 14, 2012

(54) ARTICLE OF FURNITURE, IN PARTICULAR A SITTING/STANDING TABLE

(75) Inventor: John H. Frost, Nordborg (DK)

(73) Assignee: Linak A/S, Nordborg (DK)

( * ) Notice: Subject to any disclaimer, the term of this patent is extended or adjusted under 35 U.S.C. 154(b) by 225 days.

(21) Appl. No.: 11/918,668

(22) PCT Filed: Oct. 18, 2005

(86) PCT No.: PCT/DK2005/000671

§ 371 (c)(1),
(2), (4) Date: Oct. 17, 2007

(87) PCT Pub. No.: WO2007/045238

PCT Pub. Date: Apr. 26, 2007

(65) Prior Publication Data

US 2009/0078171 A1 Mar. 26, 2009

(30) Foreign Application Priority Data

Apr. 14, 2005 (DE) ..... 10 2005 017 125

(51) Int. Cl.
*A47B 85/00* (2006.01)

(52) U.S. Cl. ..... 108/20; 108/50.01; 108/147

(58) Field of Classification Search ..... 108/20, 108/21, 50.01, 50.02, 147
See application file for complete search history.

(56) References Cited

U.S. PATENT DOCUMENTS

| | | | | |
|---|---|---|---|---|
| 4,663,537 | A * | 5/1987 | Goldner et al. | 307/10.1 |
| 4,714,025 | A * | 12/1987 | Wallin et al. | 108/20 |
| 5,752,449 | A | 5/1998 | Simon et al. | |
| 6,286,441 | B1 * | 9/2001 | Burdi et al. | 108/147 |
| 6,352,037 | B1 * | 3/2002 | Doyle | 108/20 |
| 7,049,728 | B2 * | 5/2006 | Bastholm | 310/317 |
| 7,091,692 | B2 * | 8/2006 | Ctvrtnicek et al. | 318/806 |
| 2003/0052626 | A1 * | 3/2003 | Wehmeyer et al. | 318/85 |

FOREIGN PATENT DOCUMENTS

| | | |
|---|---|---|
| DE | 10260478 | 7/2004 |
| EP | 21089 | * 1/1981 |
| WO | 02091539 | * 11/2002 |

* cited by examiner

*Primary Examiner* — Hanh V Tran
(74) *Attorney, Agent, or Firm* — Dykema Gossett PLLC

(57) ABSTRACT

The invention relates to an article of furniture, such as a sitting/standing table, wherein an adjustable element, such as a table top, may be adjusted by a drive unit (8) based on an electric motor. An electrical control unit (6) has a plurality of externally accessible gates and is arranged so as to meet a number of requirements for services and/or optional special functions which may be modified, activated or deactivated with a plurality of external modules (5) configured with a plug (11) when said plug is inserted into a gate (9).

4 Claims, 1 Drawing Sheet

ARTICLE OF FURNITURE, IN PARTICULAR A SITTING/STANDING TABLE

BACKGROUND OF THE INVENTION

1. Field of the Invention

The present invention relates to an article of furniture, in particular a sitting/standing table comprising an adjustable element, such as a tabletop, a drive unit having an electric motor for causing the adjustment of the adjustable element, an electrical control unit in a housing and a control panel for activating the drive unit.

2. The Prior Art

In step with the increasing popularity of sitting/standing tables, and the consequent intensified competition, a number of differentiated products have been developed, adapted to customer-specific needs and including a variety of new special functions. For some, the rate of adjustment may be decisive, while the lifting capability requirement is of minor importance, and, conversely, others require a great lifting capability, while the rate of adjustment is of minor importance. Examples of special functions include height indicator, control via a control panel as well as a PC, squeeze protection, etc.

In terms of logistics, it is a great task to handle all these different variants, which results in increased costs, slowness of production and distribution as well as an increased risk of wrong supplies.

The object of the invention is to make it possible to ease the logistics task and maintain the diversity of the product range at the same time.

SUMMARY OF THE INVENTION

The task is solved according to the invention in that the electrical control unit is basically manufactured with the fundamental components which are necessary for meeting the various customer-specific requirements. A plurality of modules, which may be inserted into gates in the control unit, then allow the various services and special functions to be modified, activated or deactivated. The advantage is that, if not preferably with a single one, then with just a few basic control units, it is possible to configure the control unit to customer-specific wishes. A further advantage is then that the control unit may easily be changed, if the customer's needs change. The same basic control unit, e.g., can meet the requirement of high rate and low load, and meet the requirement of higher load and lower rate with another module. With the presence of squeeze protection in the control unit, this may be made active with a module, as will e.g. a height indicator, etc. For a single function, it is also possible to have several modules to achieve a quite specific property, e.g. as regards the squeeze protection, it is possible to have a number of modules graduated so that the squeeze protection function is released at various squeeze forces. Alternatively, the module may be provided with a rotary potentiometer for adjusting the sensitivity of the squeeze function; a further alternative is a switch. In its simplest form, the module may merely consist of a simple electrical connection for reconfiguration of the control unit. Then, the customer himself may adapt the control unit to his specifications with the various plug-shaped modules, and, if the need arises, subsequently change the control unit. The modules are expediently provided with icons, indicia and colour identification which reflects the function of the module, and as a form of a modular jack they may be sent in an ordinary envelope.

Additional features of the invention will become apparent from the following description of an exemplary embodiment of the invention.

DETAILED DESCRIPTION OF THE PREFERRED EMBODIMENT

Figure 1:
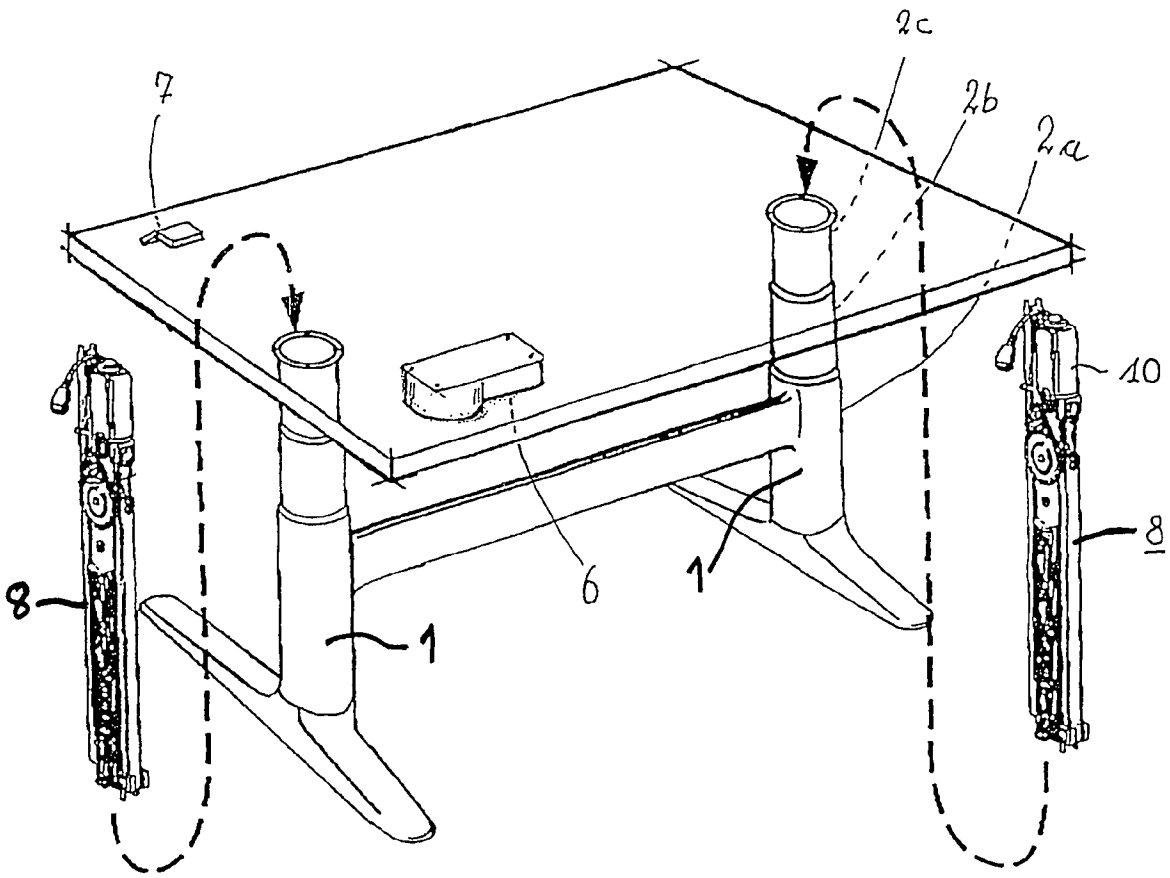
FIG. 1 shows a sitting/standing table.

The sitting/standing table shown in FIG. 1 comprises a lifting column 1 at each end and consists of three mutually telescopic sections 2*a*, 2*b*, 2*c*. The movement of the columns is caused by an incorporated drive unit 8 which is powered by an electric motor 10 connected to a control box 6 having a power supply. The control box also contains a control unit, which is activated by a control panel 7 arranged at the front edge of table. The control unit may be based on rotary potentiomers, optical or magnetic encoders for determining the height of the table top or purely electronically, as disclosed in WO 02/091539.

The table may be provided with a squeeze protection or an anti-collision protection, as disclosed e.g. in WO 03/056976 A1, or traditionally be based on measurement of the power consumption.

Figure 2:
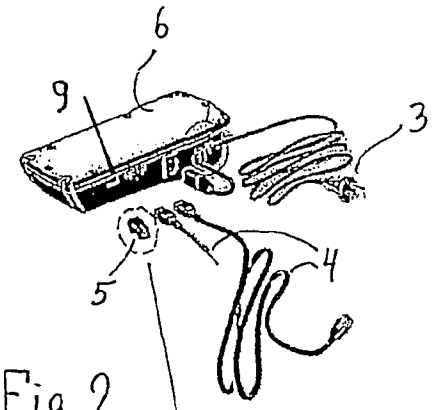
FIG. 2 shows a control box with mains and cable connections as well as a module provided with a modular jack at one end.
Figure 3:
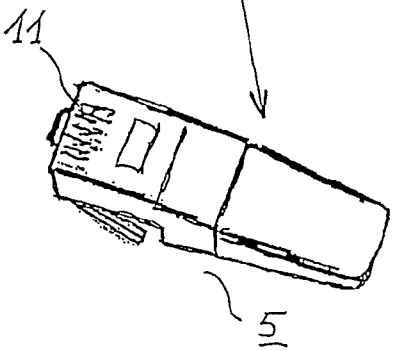
FIG. 3 shows the module on an enlarged scale.

In FIG. 2, the control box 6 is shown with a mains cable 3 and two wires 4 to the drive units 8. Moreover, one of a plurality of plug-shaped modules 5 with plug 11 at one end according the invention is shown, more particularly configured as a modular jack (RJ45 connector) which may be inserted into a gate 9 in the control box 6 intended for the purpose. The module 5 and the control unit are arranged such that the module contains a portion of the control unit, and the anti-collision protection is activated only when the module 5 is inserted into the gate 9, and only then does the anti-collision protection become complete.

In a further design, the module 5 is provided with a trim potmeter for adjusting the sensitivity of the anti-collision protection.

For convenience, the invention has been described in the foregoing on the basis of a height-adjustable table, but it will be appreciated that the invention is applicable to adjustable articles of furniture in general. Be it adjustable armchairs, beds, etc. As for beds, it may be beds for domestic use, nursing beds or hospital beds. The beds may have an adjustable backrest section, headrest section and legrest section, and as for nursing and hospital beds, the entire bed may moreover be raisable. For various reasons, e.g. in case of a fractured leg, it may be desirable to lock the legrest section, which may be done with a module as mentioned.

The invention claimed is:

1. An article of furniture comprising an adjustable element, a drive unit having an electric motor for causing adjustment of the adjustable element, a control panel for activating the drive unit, an electrical control unit in a housing for controlling the drive unit, the control unit having a mains cable and two wires connected to the drive unit, a plurality of gates for insertion of modules so as to meet a number of user specific requirements selected from services and special functions, and a plurality of external modules each having a plug for insertion into a respective gate of said plurality of gates and a memory for storing data for changing functioning of said control unit, wherein each module contains a portion of the control unit such that a user-specific function is activated only when the module is inserted into one of the gates.

2. The article of furniture according to claim 1, wherein the plug is located at one end of each module.

3. The article of furniture according to claim 1, wherein each module is configured as a modular jack (RJ45) plug.

4. An article of furniture comprising:

an adjustable element, a drive unit with an electric motor for adjusting the adjustable element, a control box containing at least part of an electric control unit for providing a plurality of functions relating to said drive unit, said electric control unit including a mains cable and two wires connected to the drive unit, and a plurality of gates, a control panel for activating the control unit, and a plurality of external modules which each has a plug for insertion in one of said gates of said control unit, and a memory for storing data for changing the functioning of the control unit relative to said drive unit wherein each module contains a portion of the control unit such that a user-specific function is activated only when the module is inserted into one of the gates.

* * * * *